US005353727A

United States Patent [19]

Goldman

[11] Patent Number: 5,353,727

[45] Date of Patent: Oct. 11, 1994

[54] COLLISION GUARD FOR A VESSEL

[76] Inventor: Jerome L. Goldman, 935 Gravier St., New Orleans, La. 70112

[21] Appl. No.: 866,577

[22] Filed: Apr. 10, 1992

[51] Int. Cl.[5] ..... B63B 43/18

[52] U.S. Cl. ..... 114/74 A; 114/12; 114/69; 114/77 R; 114/219

[58] Field of Search ..... 114/9, 10, 11, 12, 13, 114/68, 69, 78, 79 R, 79 W, 123, 219, 248, 260, 74 A, 77 R, 77 A

[56] References Cited

U.S. PATENT DOCUMENTS

| | | | |
|---|---|---|---|
| 1,266,196 | 5/1918 | Bentley | 114/13 |
| 1,299,697 | 4/1919 | Ferrati et al. | 114/78 |
| 1,337,747 | 4/1920 | Batorfy | 114/68 |
| 1,342,064 | 6/1920 | Petrusavage | 114/10 |
| 1,346,720 | 7/1920 | Perrone | 114/13 |
| 1,354,671 | 10/1920 | Magnusun | 114/13 |
| 1,361,902 | 12/1920 | Porteous | 114/219 |
| 1,729,120 | 9/1929 | Owen | 114/68 |
| 1,826,728 | 10/1931 | Camps | 114/79 R |
| 1,833,326 | 11/1931 | Krolman | 114/219 |
| 2,308,820 | 1/1943 | McQuerry | 114/69 |
| 2,321,039 | 6/1943 | Nelson | 114/13 |
| 3,021,808 | 2/1962 | Henry | 114/74 A |
| 3,028,828 | 4/1962 | Girolame et al. | 114/219 |
| 3,078,938 | 2/1963 | Bollum | 114/69 |
| 3,326,167 | 6/1967 | Paoli | 114/74 A |
| 3,990,382 | 11/1976 | Lootvoet et al. | 114/74 A |
| 4,168,672 | 9/1979 | Fletcher | 114/248 |

FOREIGN PATENT DOCUMENTS

| | | | |
|---|---|---|---|
| 8705273 | 9/1987 | PCT Int'l Appl. | 114/123 |
| 183583 | 9/1935 | Switzerland | 114/68 |
| 141299 | 4/1920 | United Kingdom | 114/360 |

*Primary Examiner*—Michael S. Huppert
*Assistant Examiner*—Thomas J. Brahan
*Attorney, Agent, or Firm*—Keaty & Keaty

[57] ABSTRACT

The invention relates to marine vessels equipped with collision guards made in the form of a fender module secured to the exterior surface of the hull and supported thereby. The module, which can be one or more in number, is filled with lightweight buoyant material and protects the hull proper from collision damage, or it can be made in the form of a hollow shell divided into a plurality of watertight compartments.

27 Claims, 2 Drawing Sheets

COLLISION GUARD FOR A VESSEL

BACKGROUND OF THE INVENTION

The present invention relates to marine vessels, and more particularly to a vessel provided with collision protection means installed directly on the hull of the vessel.

Transportation of petroleum products and other environmentally sensitive material by vessels (self propelled tankers and/or towed barges) periodically results in pollution due to accidents. The newly enacted Oil Pollution Law seeks to improve resistance of vessels to spillage resulting from collision or grounding of tank vessels. The new law requires that all U.S. craft have double bottoms and sides. These type of vessels are traditionally termed to have double hulls, since they provide empty spaces between the oil tanks and the vessel sides and bottom. In a typical large capacity vessel, the width of empty spaces is about two meters. It is acknowledged that provision of the double hulls can effectively protect against minor impacts, but will be ineffective in the case of impacts of a more serious nature.

During such impacts, a ship carrying petroleum or other sensitive cargo is frequently struck in its side by another vessel's bow. The striking vessel's bow penetrates the other vessel's side until the kinetic energy of the striking vessel is absorbed. The stuck vessel absorbs collision energy by its structure which is destroyed in the process. The exterior shell of the ship offers little resistance and most of the collision energy is absorbed by destroying areas of horizontal plating, such as decks and double bottoms. The collision can even result in a permanent damage to the ship to the point where the ship could break in two parts.

The present invention contemplates elimination of the drawbacks associated with prior art ship constructions and provision of a collision guard carried by the vessel hull so as to minimize the possible damage to the ship's structure.

SUMMARY OF THE INVENTION

It is, therefore, an object of the present invention to provide a marine vessel having a collision guard structure.

It is another object of the present invention to provide a marine vessel, wherein the collision guard is constructed of individual modules, which can be replaced, in case of damage, by similar modules without reconstructing the entire vessel.

It is a further object of the present invention to provide a collision guard which is secured to the vessel's hull in a semi-permanent way.

It is still another object of the present invention to provide a collision guard which does not reduce the speed of the vessel.

These and other objects of the present invention are achieved through a vessel which is provided with a collision guard means mounted on the exterior of the opposing side walls of the hull. The collision guard means comprises one or more buoyant modules, each separately secured to the corresponding side wall of the hull in a semi-permanent manner the module(s) do not add to the width of the hull, so as to jeopardize streamline qualities of the hull. Each module has an outer shell which is substantially entirely filled with a lightweight permanent buoyant material. Alternatively, the module(s) can be constructed with a number of watertight compartments. The shell is defined by an inner surface which generally conforms to the shape of the exterior surface of the hull's side wall, an outer wall, a closed top, and a closed bottom. Means are provided for preventing displacement of the outer wall in relation to the inner wall in the case of collision, the displacement preventing means comprising a plurality of spaced-apart horizontal or vertical members extending from the outer wall of the shell to the inner wall thereof.

The module is attached to the side wall of the hull through a securing means which comprises posts fixedly attached to a top of the shell or to a surface immediately adjacent to the top of the shell and extending upwardly therefrom. A bracket is secured to the hull of the vessel at an area co-aligned with the intended position of the module, the bracket carrying a securing member on the lower part thereof. The securing member has an opening therein which fits like a cup over at least a part of the post attached to the shell of the module. If any one of the modules becomes damaged during a collision, it can be easily removed and replaced by an identical module without the necessity to replace the entire set of guard modules at the same time. Thus, the time and cost of the vessel repair is substantially reduced.

BRIEF DESCRIPTION OF THE DRAWINGS

For a further understanding of the nature and objects of the present invention, reference will be made to the following detailed description taken in conjunction with the accompanying drawings, in which like parts are given like reference numerals, and wherein.

DETAILED DESCRIPTION OF THE PREFERRED EMBODIMENT

Figure 1:
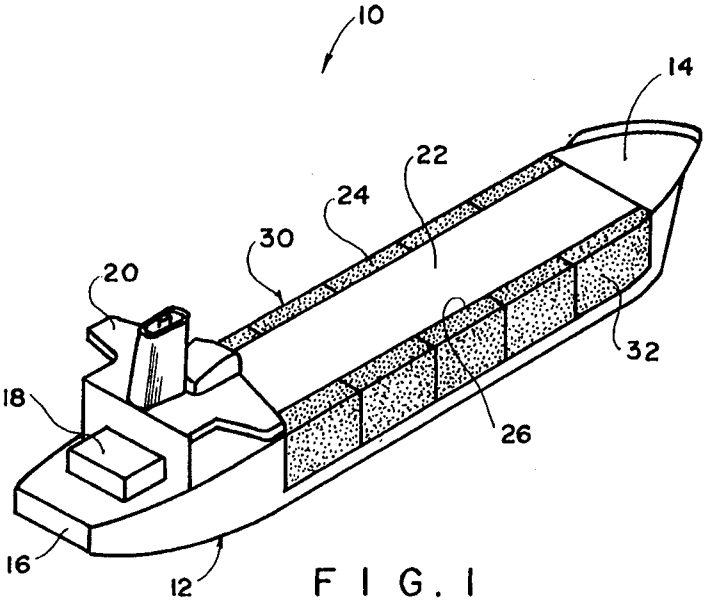
FIG. 1 is a perspective view of a marine vessel equipped with a collision guard.
Figure 2:
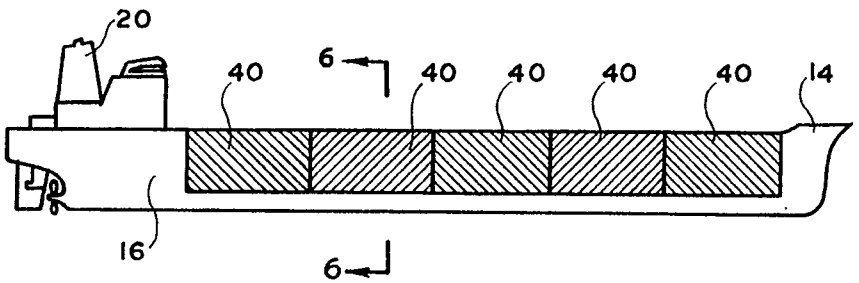
FIG. 2 is a side view of the vessel showing position of the collision guard.

Referring now to the drawings in more detail, numeral 10 designates a marine vessel in accordance with the present invention. As can be seen in the drawings, the vessel 10 comprises a hull 12 having a bow portion 14 and a stern portion 16. A conventional cargo vessel is also provided with a propulsion unit 18 and an accommodation/navigation unit 20. A cargo space 22 is formed between two opposing sides 24 and 26 of the hull structure.

Figure 3:
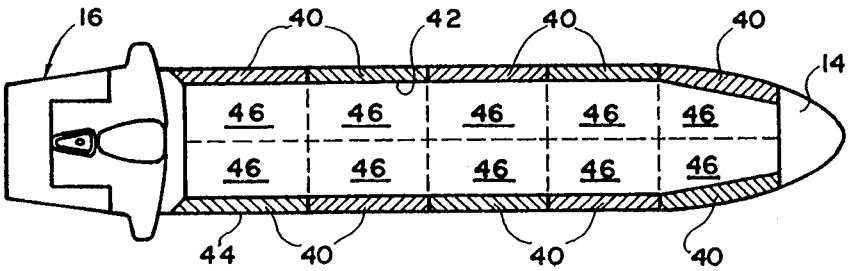
FIG. 3 is a top view of the vessel illustrating position of the collision guard modules.

It is conventional to divide the cargo space 22 into a plurality of individual compartments 46 by dividing the space 22 horizontally and vertically, as is schematically illustrated in phantom lines in FIG. 3.

The improved marine vessel in accordance with the present invention is provided with a pair of collision guards 30 and 32 secured to the exterior of the port 24 and starboard 26, respectively. Each collision guard 30 and 32 is formed from a plurality of closely fitted modules 40 which can be two, or more in number for each side. It is envisioned that for smaller vessels one module 40 would be sufficient for each side of the vessel.

As can be better seen in FIG. 3, the modules 40 are not identical but are shaped to conform along their inner walls 42 to the streamlined exterior walls of the port 24 and starboard 26.

The exterior walls 44 of the modules 40 are made contiguous with the exterior sides of the hull 12 along bow 14 and stern 16, as can be better seen in FIGS. 1 and 3. The modules 40 do not extend laterally outwardly from the widest portion of the hull 12, so as not to affect streamline qualities of the hull when the vessel 10 is in motion.

Regardless of the particular exterior shape of the module 40, that is regardless of whether it is a module adjacent the stern portion, bow portion, or the mid-section of the ship, each module comprises a casing, or shell 50 defined by an inner surface 52 and an outer shell wall 54.

Figure 4:
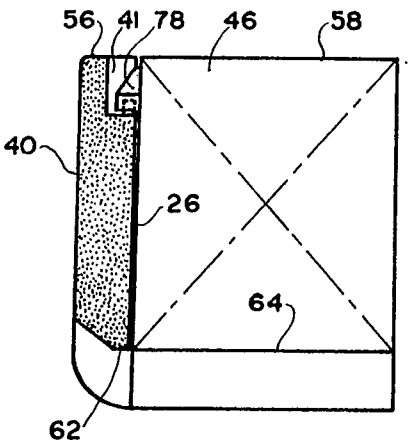
FIG. 4 is a cross-sectional view through the hull of the vessel illustrating a first embodiment of supporting the sideboard collision guards on the ship's hull.
Figure 5:
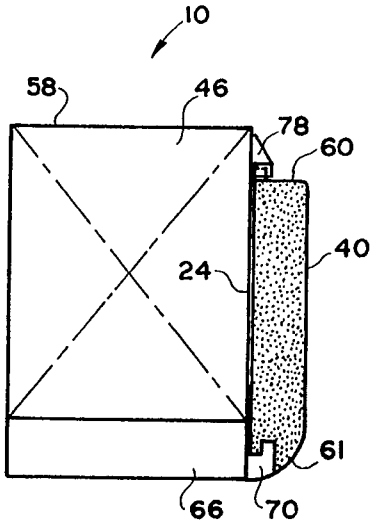
FIG. 5 is a cross-sectional view of an alternative means of securing the collision guard on the hull.
Figure 6:
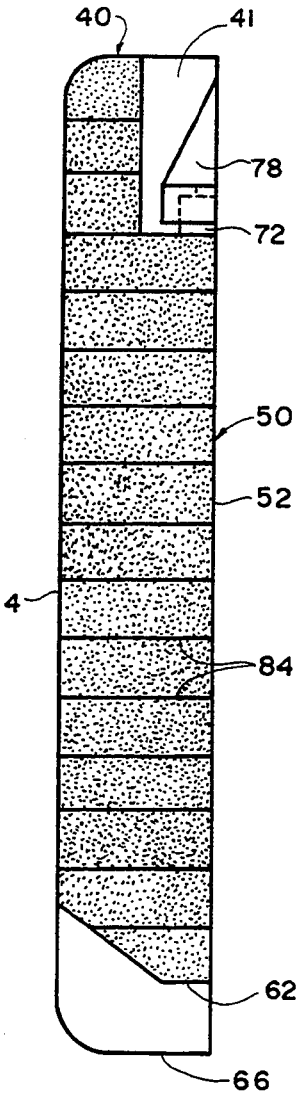
FIG. 6 is a cross-sectional view taken along lines 6—6 of FIG. 2.
Figure 7:
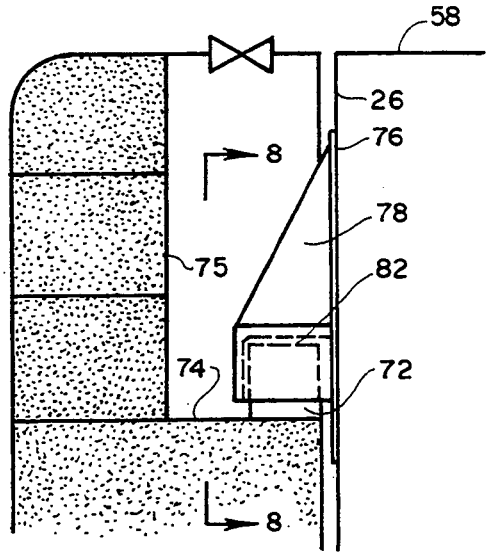
FIG. 7 is a detail view illustrating the first embodiment of a structural restraint connection of the collision guard to the vessel's structure.
Figure 8:
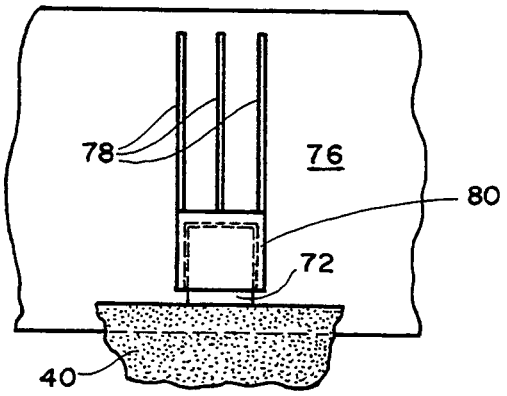
FIG. 8 is a sectional view taken along lines 8—8 in FIG. 7.

While in the embodiment illustrated in FIGS. 4 and 5 the inner wall 52 is shown to be formed by a separate plate, which forms a part of the shell 50, it will be understood that other arrangements are possible. For example, the inner wall of the module 40 can be defined by an inner surface of the buoyant material positioned within the shell 50. In that case, the shell 50 will be formed by an outer wall 54, a top wall 56 and a bottom wall 62.

The top wall 56 of the shell 50 extends to a level either substantially co-planar with the deck 58 (see FIG. 4), or as in the case with the top 60, to a level below the deck 58 (see FIG. 5).

Turning first to the embodiment of FIG. 4, the bottom 62 of the module 40 is seen to extend to a level co-planar with the inner bottom 64 of the vessel 10. In an alternative embodiment shown in FIG. 5, the bottom 68 of the module 40 is positioned adjacent to the level of the second bottom 66 of a double-bottom vessel. As shown in FIG. 5, the bottom 68 of a module 40 extends to the bilge of the vessel and rests on a module supporting "key" member 70.

The supporting member 70 is fixedly attached, such as by welding, to the bilge of the vessel and extends upwardly therefrom. A correspondingly shaped and sized opening is formed in the bottom 68 of the module 40 to allow the "key" member 70 to fit into that opening and permit the module 40 to rest on the supporting member 70.

Turning now to FIGS. 4–8, the manner of securing the modules 40 to the sides of the hull 12 will be discussed. In both embodiments (FIG. 4 and FIG. 5), the securing means comprises a post 72 made of steel, or other similarly strong material which is fixedly attached to the module 40. In the embodiment of FIG. 4 (and also seen in FIGS. 6 and 7), cutout 41 is formed in the top surface 56 of the module 40. The cutout 41 is defined by a horizontal surface 74 and a vertical surface 75. The post 72 extends vertically upwardly from the surface 74 immediately adjacent to the inner wall 52 of the shell 50. The post 72 can be square, or rectangular in cross-section, or formed in any other desired shape.

In the embodiment of FIG. 5, the post 72 is attached to a top surface 60 of the module 40 adjacent the inner wall 52 and extends vertically upwardly from the surface 60. In this embodiment the top surface 60 is below the level of the deck 58.

Regardless of the attachment place of the post 72, the securing means also comprises attachment elements of a structural restraint assembly common to both embodiments. These elements comprise a double plate 76 which is securely attached, such as by welding, or bolting to the sides 26, or 24 of the hull 12 and carries one, or more retaining brackets 78 thereon. The securing plate(s) 78 is shown to have a triangular shape in a longitudinal vertical section, as can be seen in FIGS. 4, 5, 6 and 7, although other suitable shapes can be employed.

The brackets 78 are shown to be formed from a solid metal plate but can be made in the form of an open frame, etc. The lowermost portions of the brackets 78 carry a box-like member 80 which is closed on top and is open on the bottom and the back to allow welding of the top of the member 80 to the brackets 78, and welding of the sides of the member 80 to the double plate 76.

An opening 82 is defined by the interior walls of the member 80, the opening 82 being of a size and shape suitable to receive the post 72 in a partially covering relationship thereto.

By aligning the post 72 and the opening 82, the module 40 can be brought into engagement with the attachment means elements secured to the hull 12 proper, so as to prevent any significant lateral or vertical displacement of the modules 40 during movement of the vessel 10.

Each module 40 is filled with lightweight permanent buoyant material, such as for example fire retardant foam. Alternatively, each module may contain a number of watertight spaces, as will be described in more details hereinafter.

To maximize crushing resistance of the shell 50, a plurality of spaced-apart reinforcement members 84 extend through the thickness of the shell 50 from the outer wall 54 to the inner wall 52. The reinforcement members 84 are shown to be oriented in a generally horizontal manner.

However, it is possible to arrange the members 84 in a vertical spaced-apart orientation, such that they extend from the top wall of the shell 50 to the bottom wall thereof. These reinforcement members may also be both vertical and horizontal in an "egg crate" pattern.

The reinforcement elements 84 can be in the form of steel decks, plates, a series of steel pipes, and the like. The reinforcement members 84 resist bending or displacement of the outer wall 54 during a collision by a bow of a striking vessel. Energy is absorbed by crushing these reinforcement members.

During such a collision, should any of the modules 40 be damaged, the rest of the modules will retain their buoyancy and prevent the vessel 10 from sinking by substantially adding to the buoyancy of the entire vessel. In the case of damage through collision, the guard modules 40 do not flood, while the buoyant material which fills the shell 50 absorbs a part of the energy stemming from the collision. Should a compartmental design be used instead of foam, only those spaces pierced by the collision will be flooded.

By forming an effective barrier along sides of the hull, the collision guards 30 and 32 prevent, or at least greatly reduce, the depth of penetration into the hull during a collision. In this manner, the chance of a cargo material escaping from the compartments 46 is considerably reduced, or eliminated altogether.

In cases of less severe collision, the hull itself will not even be penetrated but only one of the modules 40 be damaged. The vessel 10 can proceed safely to a port, wherein the module 40 can be removed and replaced by a new identical module, or simply repaired. In comparison with the process of repairing a conventional vessel which was damaged by collision, such approach will save time and cost to the ship's owner.

In order to dismantle one of the modules 40, the brackets 78 supporting the box enclosure 80 are removed, such as by cutting, to separate the module 40 from its engagement with a side 26, or 24 of the hull 12. The module 40 is then merely lifted by a port crane and a new identical module is lowered down to replace the damaged module. New brackets 78 and box-like enclosure 80 are welded to the double plate 76, securing a new module 40 to the hull 12.

Figure 9:
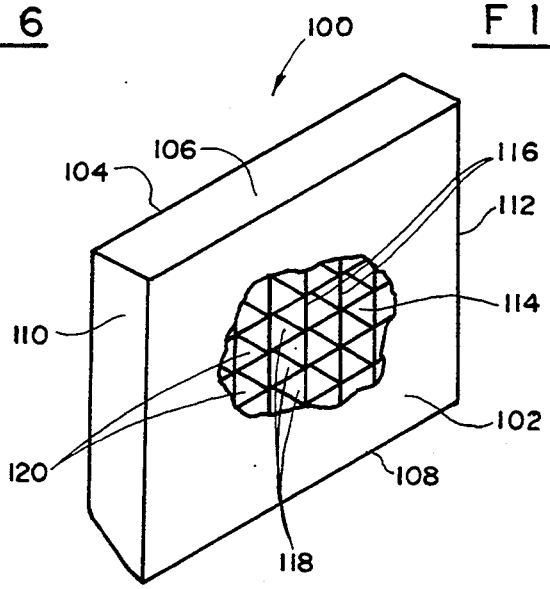
FIG. 9 is a cut-away view illustrating an alternative fender construction utilizing watertight compartments.

Referring now to the embodiment of FIG. 9, an alternative structure of a fender module will be discussed. As can be seen in the drawing, a module (which for the purposes of simplification is illustrated in the shape of a parallelepiped) 100 is shown to be defined by a pair of parallel opposing front and back walls 102 and 104, a pair of parallel opposing top and bottom walls 106 and 108, as well as a pair of parallel opposing side walls 110, 112. The walls 102, 104, 106, 108, 110, and 112 form a watertight enclosure, or interior chamber 114.

The chamber 114 is divided into a plurality of watertight compartments by a plurality of spaced-apart parallel vertical interior dividing walls 116 and a plurality of spaced-apart parallel horizontal interior dividing walls 118 which intersect at right angles the dividing walls 116. The dividing walls 116 and 118 are at least as long and as wide as the exterior defining walls of the shell 100. As a result, a plurality of watertight cubicles, or compartments 120 are formed within the interior chamber 114.

During a collision, even if one, or more of watertight compartments 120 are flooded, the remainder of the compartments 120 will retain their watertight quality and ensure a continuous buoyancy of the vessel. Since the dividing plates 116 and 118 are perpendicularly attached in relation to each other, they will also serve as reinforcement members, protecting the hull of the vessel by resisting a horizontal displacement.

The exterior walls of the module 100 can be made from steel plating, or other similar material demonstrating similar physical properties. The manner of semi-permanent attachment of the module 100 to the vessel 12 can be similar to the manner of attachment of the module 40 described above.

It is envisioned that modules 40, 100 can also be positioned on the bottom of the vessel 12 as a protection against possible underwater explosions, or running of the ship aground. The collision guard of the present invention can be also used on passenger vessels, ferry vessels as an added protection against collision damage and sinking. The guard can also be safely applied to war ships as providing side protection against explosives, as well as added resistance to capsize, or sinking.

As a result, the collision guard of the present invention provides an independent massive protection which is not a part of the ship's structure proper. The guard "fenders" are secured to the ship in a semi-permanent way, so that the ship appears identical to a one-piece integral construction and functions as an integral structure. The guards provide both a collision energy absorption and a resistance to damage by explosion. The shells 50 are filled with lightweight buoyancy material of a permanent nature. Any damaged module 40 can be easily replaced with a minimum of vessel's operational time lost.

The foregoing described preferred embodiment showing a particular ship configuration or type is an exemplary for the purpose of illustrating the principles of the present invention, which are applicable to all kinds of ship designs other than the particular one illustrated.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

I claim:

1. A marine vessel, comprising:

a floatable hull having opposing side walls and defining a cargo space portion, said hull carrying a structural restraint assembly which comprises at least one post engaging member; and a collision guard means mounted on exterior of each of the opposing side walls forming an outer shell which extends fore and aft substantially along said cargo space portion of said hull, said hull having recessed portions for mounting said collision guard means so as to retain streamline qualities of the hull, said collision guard means extending at least to some distance below a water line, said collision guard means comprising at least one buoyant module having an inner wall which conforms to at least a part of the exterior surface of a hull side wall and an upwardly extending securing post fixedly attached to said at least one buoyant module, said post engaging member capping at least a part of said securing post and including means for fixedly securing the post engaging member to the hull for preventing any significant displacement of said at least one module in relation to the hull.

2. The vessel of claim 1, wherein said module is provided with a cutout formed in an upper portion of the module, said cutout being defined by a horizontal surface and a vertical surface.

3. The vessel of claim 3, wherein said post securing means comprises a means for fixedly attaching said post securing means to the hull.

4. The vessel of claim 3, wherein an exterior of a hull side wall carries at least one bracket, said post engaging member being carried by said at least one bracket.

5. The vessel of claim 4, wherein said post engaging member is provided with an opening in a bottom portion thereof, said opening being sized and shaped to allow at least a part of the post to be received within said post engaging member.

6. The vessel of claim 1, wherein said at least one module comprises an outer shell which comprises an inner wall and an outer wall.

7. The vessel of claim 6, wherein said at least one module is provided with internal means for resisting lateral displacement of the outer wall in case of an impact of the outer wall during a collision.

8. The vessel of claim 7, wherein said displacement resisting means comprises a plurality of reinforcement members extending from the outer wall to the inner wall of said shell and positioned in a spaced-apart relationship to each other.

9. The vessel of claim 6, wherein said shell further comprises a closed top and a closed bottom.

10. The vessel of claim 9, wherein said top extends to a level substantially co-planar with a level of a vessel deck, and said bottom extends to a level adjacent to a vessel bottom.

11. The vessel of claim 6, wherein said top extends to level below an upper deck of the vessel, and said bottom extends to a level of a vessel bilge.

12. The vessel of claim 11, further comprising means for supporting the bottom of the shell.

13. The vessel of claim 12, wherein said supporting means comprises an upwardly extending support member which is secured to the bilge and engages the bottom of the shell.

14. The vessel of claim 13, wherein said shell bottom is provided with a corresponding cutout to allow the shell bottom to fittingly engage the support member.

15. The device of claim 6, wherein said shell is substantially entirely filled with a lightweight permanent buoyancy material.

16. The device of claim 6, wherein said shell has an inner chamber divided into a plurality of watertight compartments.

17. The vessel of claim 1, wherein said collision guard means comprises a plurality of buoyant modules, each separately secured to a side wall of the hull in immediate proximity to each other.

18. A marine vessel, comprising:

a floatable hull having opposing side walls and defining a cargo space portion;

a collision guard means mounted on exterior of each of the opposing side walls, forming an outer shell which extends fore and aft substantially along said cargo space portion of said hull, said hull having recessed portions for mounting said collision guard means, so as to retain streamline qualities of the hull, said collision guard means extending at least some distance below a water line, said collision guard means comprising at least one buoyant module having an inner wall surface which conforms to the exterior surface of a hull side wall; and means for securing the collision guard means to the hull, said securing means comprising an upwardly extending post fixedly attached to an upper part of said at least one module and a structural restraint assembly carried by a hull side wall, said structural restraint assembly including means for fixedly securing the restraint assembly to the hull, said restraint assembly engaging the post so as to prevent any significant displacement of said at least one module in relation to the hull.

19. The device of claim 18 wherein said at least one module is provided with a cutout formed in an upper portion of the module, said cutout being defined by a horizontal surface and a vertical surface.

20. The vessel of claim 19, wherein said said structural restraint assembly comprises at least one bracket securely attached to the exterior of the side wall of the hull and extending outwardly therefrom, and a post engaging member carried by said at least one bracket.

21. The vessel of claim 20, wherein said post engaging member is provided with an opening in a bottom portion thereof, said opening being sized and shaped to receive at least a part of the post therein.

22. The vessel of claim 18, wherein said at least one module comprises a shell comprising an inner wall and an outer wall, and wherein said least one module is provided with internal means for resisting lateral displacement of the outer wall.

23. The vessel of claim 31, wherein said displacement resisting means comprises a plurality of reinforcement members extending from the outer wall to the inner wall of the shell and positioned in a spaced-apart relationship to each other.

24. The vessel of claim 23, wherein said supporting means comprises an upwardly extending support member which is secured to the bilge of the hull and engages the bottom of the shell.

25. The vessel of claim 22, wherein said shell further comprises a closed top and a closed bottom, and wherein said hull is provided with means for supporting the bottom of said at least one shell.

26. The vessel of claim 25, wherein said shell bottom is provided with a corresponding cutout to allow the shell bottom to fittingly engage the support member.

27. The vessel of claim 18, wherein said collision guard means comprises at least one buoyant module having an inner surface which conforms to the exterior surface of a corresponding side wall, said at least one module having an inner chamber divided into a plurality of watertight compartments.

* * * * *